US006276435B1

(12) United States Patent
Ricketts et al.

(10) Patent No.: US 6,276,435 B1
(45) Date of Patent: Aug. 21, 2001

(54) CASTING WHEEL

(75) Inventors: Nigel Jeffrie Ricketts, Queensland 4077; Craig John Korn, Springfield, Queensland 4300, both of (AU); Phillip Wilmott Baker, Oakville, Ontario L6J 2A6 (CA)

(73) Assignees: Commonwealth Scientific and Industrial Research Organisation, Campbell Australian Capital Territory 2612 (AU); Australian Magnesium Operations Pty Ltd, Toowong 4066 (AU)

( * ) Notice: Subject to any disclaimer, the term of this patent is extended or adjusted under 35 U.S.C. 154(b) by 0 days.

(21) Appl. No.: 09/214,815

(22) PCT Filed: Jul. 23, 1997

(86) PCT No.: PCT/AU97/00462

§ 371 Date: Aug. 23, 1999

§ 102(e) Date: Aug. 23, 1999

(87) PCT Pub. No.: WO98/03283

PCT Pub. Date: Jan. 29, 1998

(30) Foreign Application Priority Data

Jul. 23, 1996 (AU) ..... PO1183

(51) Int. Cl.[7] ..... B22D 37/00; B22D 39/00

(52) U.S. Cl. ..... 164/337; 164/136; 222/591

(58) Field of Search ..... 164/155.1, 155.2, 164/130, 325, 326, 336, 337, 136; 222/591, 594, 598

(56) References Cited

U.S. PATENT DOCUMENTS 4,168,739 9/1979 Smith et al. .
5,398,750 * 3/1995 Crepeau et al. ..... 164/154.2
5,879,721 * 3/1999 Bradley ..... 425/218

FOREIGN PATENT DOCUMENTS

1409409 A1 7/1988 (AU) .
0 327 485 8/1989 (EP) .
04033748 2/1992 (JP) .
04003748 * 2/1992 (JP) ..... B22D/5/04

OTHER PUBLICATIONS

EP Supplementary Search Report, Sep. 21,1999.

* cited by examiner

*Primary Examiner*—Kuang Y. Lin
(74) *Attorney, Agent, or Firm*—Rodman & Rodman

(57) ABSTRACT

A casting wheel (10) for use in filling ingot molds (36) of an ingot mold line has a wheel member (12) comprising a hub (14) and a plurality of spouts (20). The wheel member (12) has a central region (18) and is mounted by the hub (14) for rotation on an axis of rotation. The spouts (20) are formed from sheet metal and are integral with the hub (14). The spouts (20) extend outwardly from the central region (18) in an angularly spaced array and each spout has an inlet end (23) adjacent the central region (18) and an outlet end (24) remote from the hub (14). The casting wheel (10) additionally comprises means for mounting the wheel member for rotation on the axis of rotation, a conveyor (34) on which a series of ingot molds (36) are movable below the wheel member (12) along a mold line (36) extending transversely with respect to the axis, means for rotating the wheel member (12), means for advancing the conveyor (34) to move each mold (36) in turn to a filling position below a pouring position for spouts (20) of the wheel member (12), and molten metal feed means for supplying molten metal to the wheel member (12). The means for rotating the wheel member (12) and the means for advancing the conveyor (34) are operable in synchronism.

14 Claims, 6 Drawing Sheets

CASTING WHEEL

FIELD OF THE INVENTION

The present invention relates to casting wheels for use in filling ingot moulds in automatic metal ingot moulding lines, and to a wheel member for such a casting wheel.

BACKGROUND TO THE INVENTION

Casting wheels (or rotating launders) are commonly used in the aluminium industry. Casting wheels have also occasionally been used for the casting of ingots of other metals.

The general construction of a casting wheel includes a number of spouts (sometimes referred to as buckets) positioned on the perimeter of a wheel which is designed to rotate about its axis. The casting wheel is usually indexed to a substantially flat conveyor which includes a number of ingot moulds. The number and positioning of the spouts on the casting wheel is indexed such that each spout corresponds to one mould and allows for the filling of the mould with molten metal from the spout.

The general objective of all casting wheels is to provide an apparatus to prepare ingots of substantially equal size and weight which are free from scum and dross.

Problems associated with known casting wheels include the formation of blockages in the pouring spouts; poor design of the spouts such that the molten metal experiences excessive turbulence when poured into the mould and results in excessive dross; complex construction; and difficulty of cleaning and maintenance.

Consistent ingot weight is only achieved if spout blockages do not occur. Such blockages occur due to either oxide or dross formation. Dross formation would appear to be worse in the case of metals such as magnesium than for aluminium, although some inconsistency in operation does occur with current aluminium casting wheels.

The turbulence issue is a function of the casting wheel design, the way metal is added into the casting wheel and the location of the spout tips in relation to the height of metal in the ingot mould. Most aluminium casting wheels are of a squat cylindrical design and run with a pool of metal in an open main trough or launder. When this pool encounters a spout, metal flows into the spout and then into the mould, hopefully in such a way as the top surface skin of the metal in the pool is not disturbed. In practice, this usually means pouring more than one mould at a time. This can cause metal to flow into the mould when the spout tip is 5–10 cm above the mould bottom, causing splash and drossing.

In addition, the method of construction of the casting wheel needs to be addressed. They are usually cast from steel or iron or are fabricated from heavy gauge steel and are provided with some form of mould wash or coating. If the thermal mass of the casting wheel is too large, extensive heating of it is required to prevent freezing of the metal in the casting wheel. Known cast wheels need to have thick sections to enable them to be cast successfully. Cast wheels are normally limited production items of complex design and so the casting costs are usually high.

Further problems are observed if casting wheels are used for casting metals such as magnesium where the metal is cast under an inert or protective gas as gas heating cannot be used.

At least in preferred forms, the present invention is concerned with casting wheels, and wheel members for such wheels, which are suitable for casting magnesium or magnesium alloys.

SUMMARY OF THE INVENTION

In a first aspect, the present invention provides a wheel member, for a casting wheel for use in filling ingot moulds of an ingot mould line, the wheel member comprising:

- a hub by which the wheel member is arranged to be mounted for rotation on an axis of rotation and which defines a central region; and
- a plurality of spouts formed from sheet metal which are integral with the hub and extend outwardly from the central region in an angularly spaced array, each spout having an inlet end adjacent the central region and an outlet end remote from the hub.

Preferably, the wheel member is formed from metal components which are secured together to provide an integral rigid structure. This enables the wheel member to be readily designed for a specific installation. Preferably, the metal components are welded together. The spouts are formed from sheet metal and, to enhance rigidity, the hub is typically formed from relatively thin metal plate, for example, in the order of 10 mm thick plate. The sheet metal from which the spouts are formed can be of relatively thin thickness, such as from about 1.5 mm to 4 mm thick, for example, about 2 mm thick. The sheet metal is preferably of low thermal mass. For example, the spouts may be formed from steel, titanium or a titanium alloy such as palladium stabilised titanium. The wheel member may therefore have a low thermal mass which obviates the need for heating other than by molten metal being cast in order to prevent freezing of the molten metal. Additionally, the inside of the spouts may be coated with a heat insulating material to reduce heat transfer to the spouts from molten metal flowing through the spouts. For example, the inside of the spouts may be plasma sprayed with alumina.

The wheel member may be of either of two distinct forms. In a first of these forms, the spouts are of open channel form in which molten metal flowing from the inlet to the outlet of successive spouts, in turn, is fully exposed to the surrounding atmosphere which, depending upon the metal being cast, may be an inert or protective atmosphere. In the other distinct form, each spout is of closed channel form between its inlet and outlet ends and, in that case, the outlet end typically is submerged in molten metal of a mould being filled.

In a first preferred embodiment, the wheel member principally is intended to be mounted for rotation about a substantially horizontal axis of rotation, and is rotatable so that each spout in turn moves to a melt pouring position in which it projects downwardly and forwardly from the hub. The spouts diverge outwardly and forwardly from the hub in a frusto-conical array, at a half cone-angle which is such as to ensure that each spout, when in the pouring position, is inclined downwardly and forwardly at an angle providing required, controlled flow of the melt.

In a second preferred embodiment, the axis of rotation preferably is inclined to the horizontal at an acute angle with the spouts generally perpendicular to that axis, such that each spout is inclined downwardly and forwardly when in the pouring position at an angle providing controlled flow of the melt.

It is to be understood that the first and second embodiments are opposite extremes. Thus, in a third preferred embodiment, each spout may be at a required angle providing controlled flow of the melt as a consequence of the spouts diverging at a greater half cone-angle than for the first embodiment, but with the axis of rotation being at a lesser angle to the horizontal than in the second case embodiment.

In each of the first, second and third embodiments, the arrangement preferably is such that each spout has a longitudinal centre-line which is in a respective radial plane of the wheel member which contains the axis of rotation. For a spout in the pouring position, such plane most preferably is substantially vertical. The inclination of the axis of rotation and of the spouts preferably is such that a spout, when in the pouring position, is inclined downwardly and forwardly from the hub at an angle of from about 25° to about 45° to the vertical, such as at an angle of about 30° to the vertical.

The spouts of the first, second and third embodiments may be of open, channel form. A variety of cross-sectional configurations are suitable for this, for example, V-section. In any event, it is desirable that, in cross-section, opposite side walls of each spout are inclined downwardly and inwardly towards each other. Most preferably the outer end of each spout has a transverse end wall over which molten metal issues as a thin curtain when the spout is in its pouring position. Such end wall, when its spout is in that position, most preferably is inclined downwardly and forwardly at a relatively shallow angle with respect to the horizontal, such as at an angle of from 5° to 25°, for example at about 20° to the horizontal. However, the end wall may be horizontal.

In a fourth preferred embodiment of the wheel member according to the present invention, each spout curves outwardly and forwardly from the hub and has the form of a forwardly open scoop. In the fourth embodiment, each spout has an arcuate centre region along which molten metal is able to flow from its inlet end to its outlet end. The centre region may be defined by an arcuate junction between respective mutually inclined side walls of its spout. However, it is preferred that the centre region is defined by an arcuate basal wall which joins respective side walls of its spout.

In a fifth preferred embodiment of the wheel member, principally intended for submerged filling of moulds, each spout is of closed channel form between its inlet and outlet ends. From the inlet end to the outlet end, each spout has a front wall along which molten metal is able to flow for discharge from an outlet defined at the outlet end, preferably to provide for submerged filling of moulds. Each front wall, at the inlet end of its spout, is spaced forwardly from the hub and is inclined so as to extend outwardly and rearwardly towards a plane containing the hub. Each spout also has respective side walls and a rear wall, so as to be of rectangular form in cross-section where each wall is substantially planar. However, the front wall may be internally concave in cross-section so as to merge with each side wall, to give each spout a D-shape in cross-section.

In a sixth preferred embodiment, the arrangement is similar to that of the fifth embodiment. However, in the sixth embodiment which also is intended for submerged filling of moulds, each spout has a rear wall along which molten metal is able to flow to an outlet defined at the outlet end. Such rear wall, at the inlet end of its spout, extends outwardly and forwardly from the hub. Each spout has respective side walls and a front wall, so as to be of rectangular form in cross-section where each wall is planar. However, the rear wall may be internally concave, so as to merge with each side wall, to provide a D-shape in cross-section.

Each of the fourth, fifth and sixth embodiments most conveniently is adapted for rotation on a substantially horizontal axis of rotation. However, each of these embodiments can be adapted for rotation on an inclined axis of rotation.

In each embodiment, successive spouts preferably are joined at their inner ends along a forwardly extending junction between their side walls or side wall portions. In each case, the arrangement preferably is such that each junction defines a relatively sharp divide between the inlet end to successive spouts, which facilitates the diversion of molten metal from a spout leaving the pouring position to a spout at or close to that position.

As indicated, the spouts are formed of metal sheet, such as mild steel or alloy steel. This enables attainment of the required rigidity at a lesser wall thickness than is necessary for a wheel member cast of iron or steel, thereby saving in material and production costs. Also the thinner wall thickness possible with a wheel member having spouts fabricated from sheet metal results in a reduction of heat loss from the molten metal to the wheel member, with a reduced risk of the molten metal solidifying and/or a reduced requirement for heating of the wheel member to avoid solidification of the molten metal.

In a second aspect, the present invention provides a casting wheel comprising a wheel member according to the first aspect of the present invention, means for mounting the wheel member for rotation on the axis of rotation, a conveyor on which a series of ingot moulds are movable below the wheel member along a mould line extending transversely with respect to the axis, means for rotating the wheel member, means for advancing the conveyor to move each mould in turn to a filling position below a pouring position for spouts of the wheel member, and molten metal feed means for supplying molten metal to the wheel member, the means for rotating the wheel member and the means for advancing the conveyor being operable in synchronism.

The means for rotating the wheel member and the means for advancing the conveyor are operable in synchronism. Preferably, the arrangement is such that, as each mould approaches the filling position, it moves into vertical or near vertical alignment below the outlet end of a spout which is approaching the pouring position. In further movement of the mould, that outlet end enters the mould and is at a lowermost position in the mould when the latter is at the filling position and the spout is at the pouring position. The lowermost position most preferably is sufficiently close to the base of the mould as to substantially prevent dross formation during the pouring of molten metal into the mould. With still further movement of the mould, the lower end of the spout is elevated within the mould during a filling operation and subsequently is elevated out of the mould, and the latter passes beyond the wheel member. Simultaneously, next successive moulds are moved along the mould line, each relative to a respective one of next successive spouts of the wheel member. Rotation of the wheel member and the conveyor may be continuous. Alternatively, it may be in an intermittent, step-wise fashion.

The molten metal feed means may include an open launder or, for some metals, a pipe, along which molten metal is conveyed to the wheel member from a suitable source. The launder or pipe preferably has an outlet end adjacent to the central region of the hub of the wheel member, to enable discharge of molten metal into the inlet end of a spout at the pouring position. Alternatively, the molten metal feed means may comprise a tundish.

The molten metal feed means may discharge molten metal at a location close to, but spaced from, the central region so as to pass directly to the inlet end of a spout in the pouring position. That is, the flow of molten metal need not, and preferably does not, contact the central region. However, the central region may be of dished form and particularly in such case, it may serve to guide molten metal in flow from the feed means to the inlet end of a spout in that position.

When rotation of the wheel member and drive to the conveyor is step-wise, the wheel member and the conveyor is stopped as each successive spout and mould respectively reaches the pouring the filling positions. At least partial filling of the mould then is effected, if necessary with the supply of molten metal having been momentarily terminated or reduced after completion of filling of the preceding mould. However, on commencement of filling of a mould at the filling position, rotation of the wheel member and drive to the conveyor again is initiated, such that completion of filling of the mould is achieved as it moves beyond the filling position. That is, filling of the mould is asymmetric with respect to its movement to and beyond the filling position. Such asymmetric filling has the benefit of enabling the outlet end of a spout to be elevated, relative to its mould, as a consequence of rotation of the wheel member. This elevation may be such as to maintain the outlet end of the spout a short distance above the rising level of molten metal in the mould or with the outlet end submerged and elevated with the rising level of molten metal in the mould. In either case, asymmetric filling preferably also is achieved when rotation of the wheel member and drive to the conveyor is continuous.

The molten metal feed means preferably is arranged relative to the wheel member in a manner which facilitates attainment of such asymmetric filling. There are two arrangements which achieve this, although they can if required be used in combination.

In the first arrangement, the molten metal feed means has an outlet which is laterally offset from the axis of rotation to that half of the wheel member to which a spout first rotates on leaving the pouring position. As a consequence of this, the feed means outlet is able to be above, and discharge molten metal to, the inlet end of a spout during a time and angular distance interval of movement of the inlet end of the spout beyond the pouring position. In the second arrangement, the molten metal feed means conveys the molten metal along a line, to its outlet, such that on issuing from the outlet, the molten metal has a downward flow path having a lateral component of movement towards the half of the wheel member referred to above. Again, in the second arrangement, the outlet of the feed means is able to discharge molten metal to the spout melt end over such time and distance interval.

The spouts preferably decrease in cross-section from the inlet end to the outlet end. This most conveniently is as a consequence of mutually inclined side walls which, while at a constant angle to each other, decrease in height to the outlet end. Adjacent the hub, the side walls of each spout may diverge towards the inlet end such that each side wall merges with, and is joined to, an adjacent side wall of the next adjacent spout. The junction between side walls of adjacent spouts preferably projects forwardly from the hub, such as forwardly and outwardly. The junctions may define a relatively sharp separation between the inlet end of successive spouts which facilitates the cutting-off of molten metal feed to one spout as the next following spout approaches the pouring position.

Any suitable molten metal feed means may be used. The selection and design of the feed means will depend upon the type of molten metal and the temperature thereof. For metals such as lead or magnesium the feed means preferably includes a pump and steel pipe.

The wheel member may have any suitable number of spouts. Factors affecting the choice of number of spouts include the size, weight and overall cost of construction of the wheel. The number of spouts also can alter the production rate of ingots. Generally the greater the number of spouts the greater the production rate. In a preferred embodiment the wheel member has from 6 to 12 spouts.

In a preferred embodiment of the invention each spout is designed such that the internal surfaces, along which molten metal is to flow, slope from the inlet end to the outlet end thereof. The surfaces may be flat or curved. This design substantially reduces the risk of dead zones and minimises blockages due to dross formation or metal freezing and allows for the production of substantially consistent ingot weights. The sloping surfaces also can minimise turbulence of the molten metal when filling an ingot mould, thereby minimising dross formation. Open spout constructions enable greater visibility of a casting operation, resulting in better control of the production of ingots, and allows for easier cleaning and maintenance. However, closed spout constructions are able to be provided with a separable cover portion to facilitate cleaning and maintenance.

In a preferred embodiment of the invention each spout is designed such that all the internal surfaces, along which molten metals is to flow, slope from the inlet end to the outlet end. Such angular design of the spouts forms an inherently stiff structure making the use of heavy steel sections unnecessary. This results in a casting wheel of substantially less thermal mass than cast wheel members and is important for metals with low heat capacity such as magnesium as it allows them to be cast with less possibility of freezing and causing blockages in the spouts. It also means that the cost associated with pre-heating buckets or spouts can be minimised.

Known casting wheels are designed and constructed such that their axis of rotation is in a substantially horizontal plane. However, the present invention enables a departure from this, in that it is possible to use the casting wheel of at least some embodiments at an inclined axis. This arrangement can further minimise turbulence of the molten metal pouring into the moulds.

BRIEF DESCRIPTION OF DRAWINGS

Preferred embodiments of the present invention will now be described, by way of example only, with reference to the accompanying drawings, in which.

DETAILS DESCRIPTION OF DRAWINGS

Figure 1:
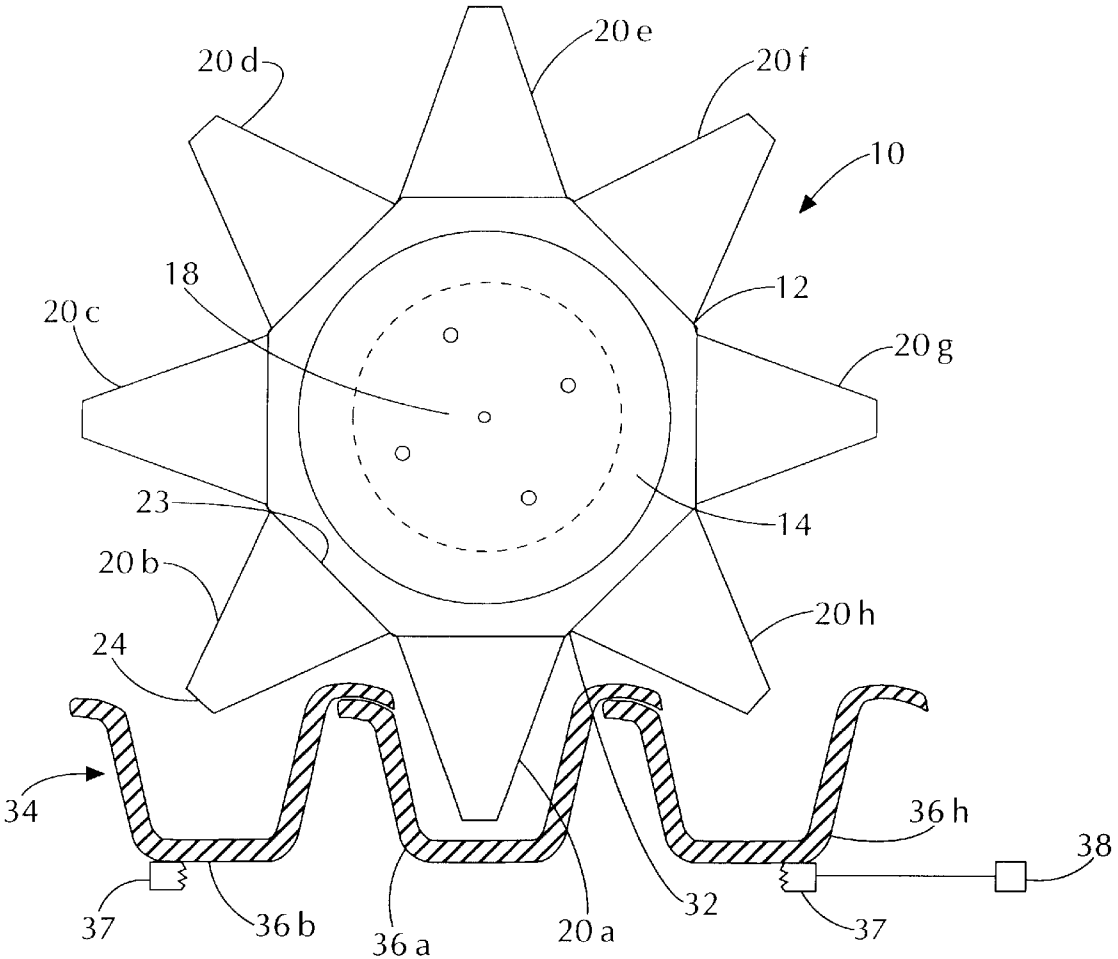
FIG. 1 is a partial front elevation of one form of a casting wheel of the present invention.
Figure 2:
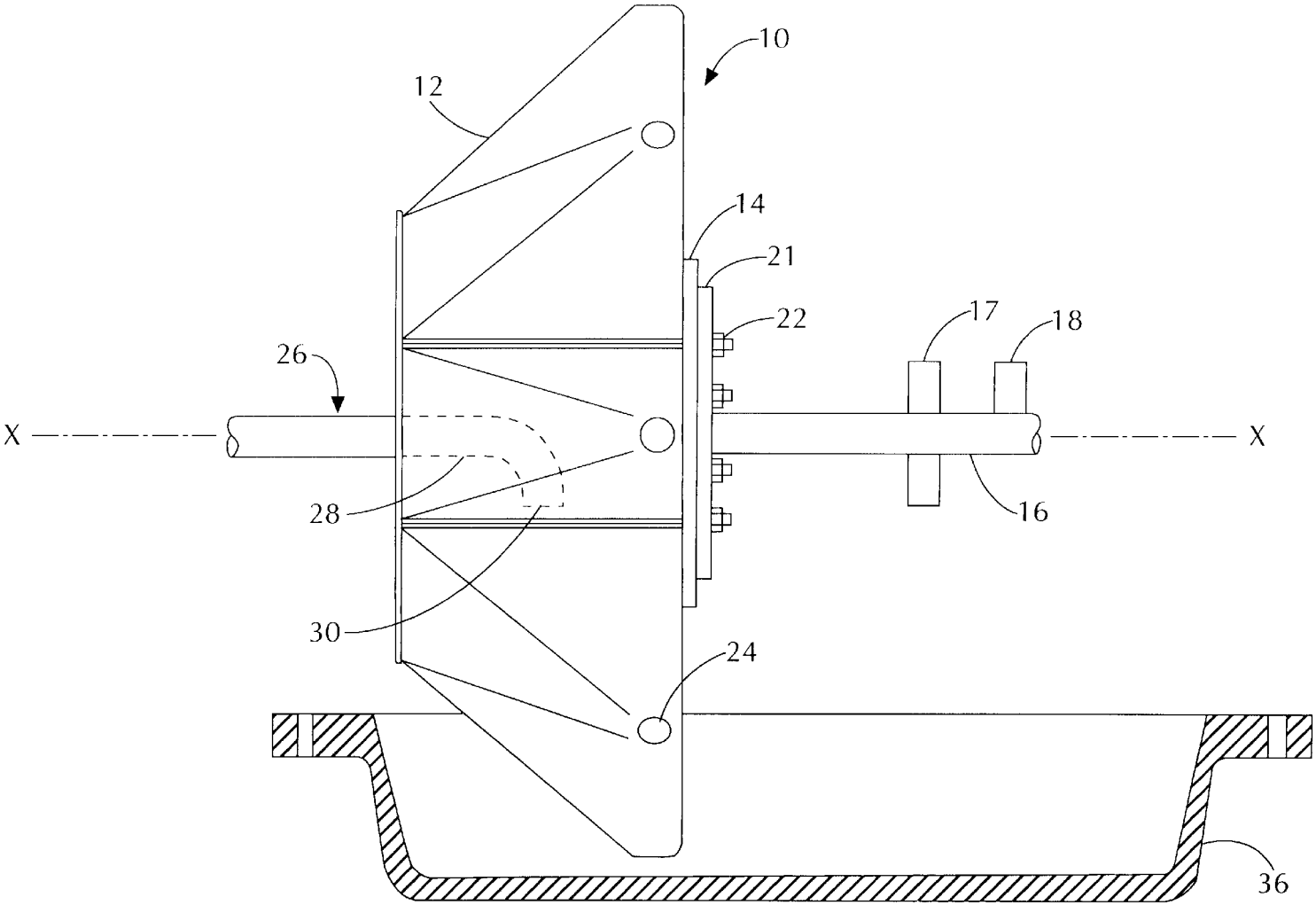
FIG. 2 is a side elevation of the casting wheel as shown in FIG. 1.

Referring firstly to FIGS. 1 and 2 of the drawings, the casting wheel 10 includes a wheel member 12 arranged for rotation about a horizontally disposed axis X—X. Wheel member 12 has a central hub 14 by which it is rotatable with shaft 16 and which defines a central region 18. Wheel member 12 is formed with eight spouts 20*a* to 20*h* (referred to collectively as spouts 20).

Shaft 16 is journaled in bearings 17 (FIG. 2) and rotatable under the action of suitable drive means 18. Across its forward end, shaft 16 has an integral end plate 21, to which hub 14 is secured by bolts 22.

Figure 3:
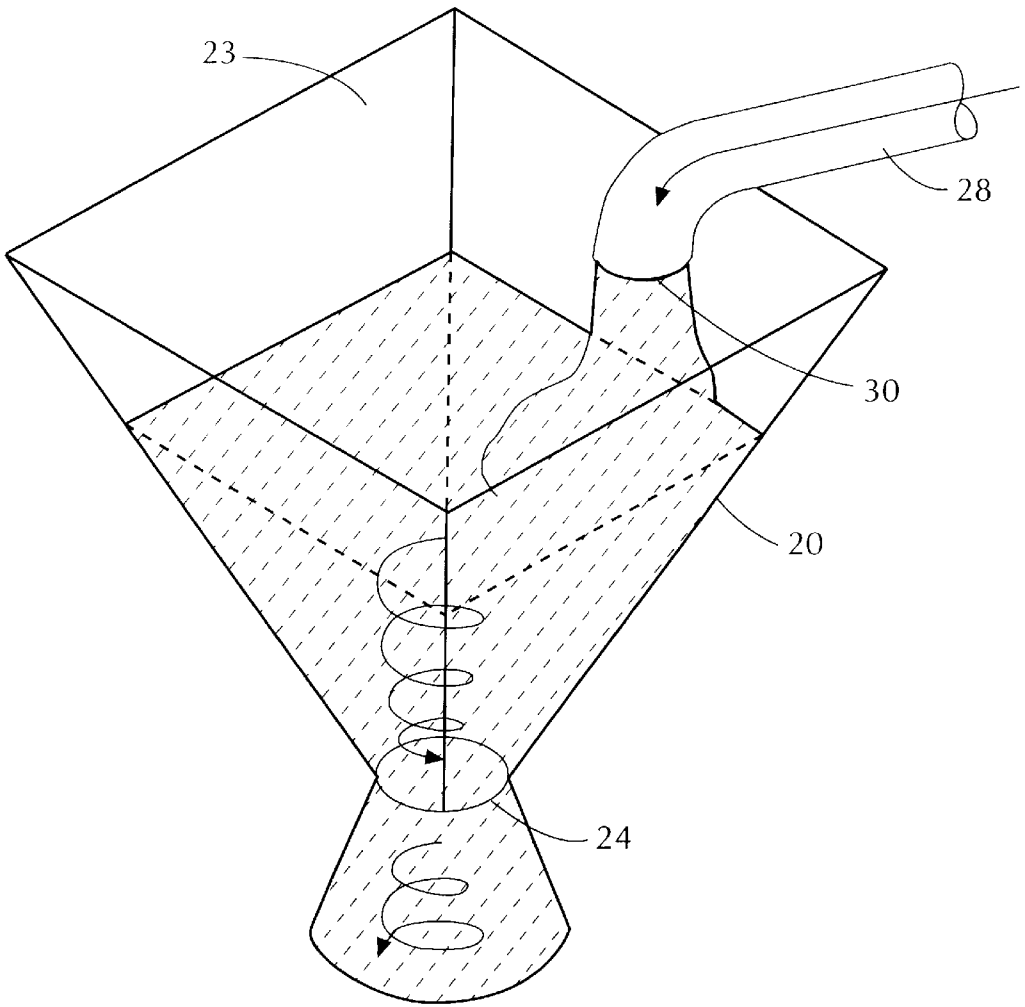
FIG. 3 is a perspective view of a spout of a casting wheel of FIGS. 1 and 2.
Figure 4A:
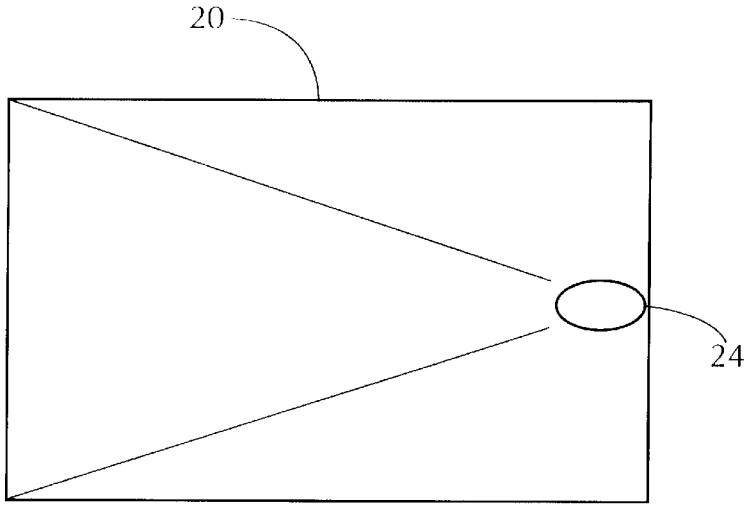
FIGS. 4*a* and 4*b* are inverted plans of spouts similar to FIG. 3.
Figure 4B:
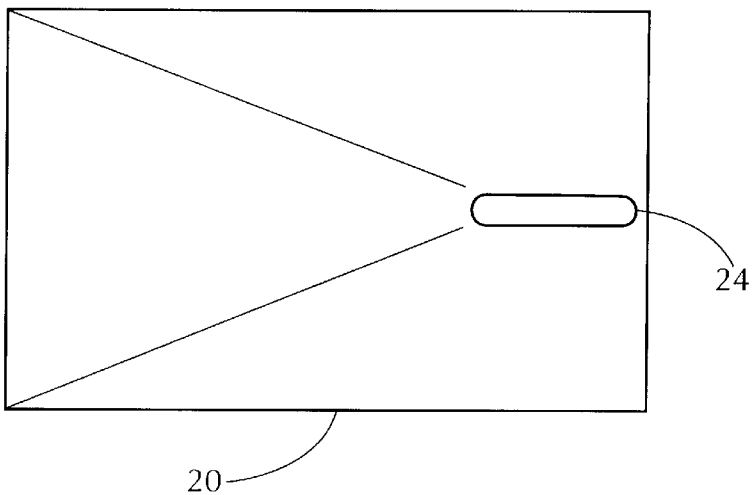

Referring to FIG. 3, each spout 20 is in the form of a closed truncated rectangular based pyramid having an inlet end 23 and a circular outlet end 24. As illustrated in FIGS. 4*a* and 4*b*, the outlet end 24 may have a variety of shapes including elliptical and an elongated slot.

Wheel member 12 is formed principally of 2 mm thick steel sheet components which are welded together; hub 14 comprising 10 mm circular plate for rigidity. Although made from relatively light steel sheet and plate, the construction has a high level of rigidity.

The casting wheel 10 also includes molten metal feed means 26, having a supply pipe 28 by which molten metal is able to be conveyed to the wheel member 12 from a suitable source (not shown). Pipe 28 terminates, adjacent central region 18, at a down-turned discharge end 30. The arrangement is such that pipe 28 is able to discharge molten metal from its discharge end 30 for flow into the inlet end of a spout 20 when the latter is at a pouring position vertically below axis X—X.

In the arrangement as shown in FIG. 1, the wheel member 12 is rotated by shaft 16 in an anti-clockwise direction. This brings each spout 20, in turn, to and then beyond the pouring position. The pouring position is occupied by spout 20*a* shown in FIG. 1. Pipe 28 is mounted so as to locate its discharge end 30 asymmetrically with respect to axis X—X; discharge end 30 being laterally offset slightly to the half of the wheel member 12 to which each spout 20 rotates, in turn, on leaving the pouring position. Thus, flow of molten metal from discharge end 30 to the inlet end 23 of a spout 20 commences a short interval before the spout reaches that position, and is terminated after a larger interval of movement of the spout beyond that position.

The junction 32 between each pair of successive spouts 20 functions as a molten metal flow diverter. The junction 32 between the spout 20*a* shown in the pouring position in FIG. 1 and preceding spout 20*h* is in a position in which the flow of molten metal is split between those spouts 20*a* and 20*h*. Until a short interval prior to spout 20*a* reaching the pouring position, all flow is to inlet 23 of spout 20*h*. However, as spout 20*a* approaches and then moves beyond the pouring position, junction 32 commences to divert an increasing proportion of the metal flow from spout 20*h* to spout 20*a*, until all flow is to spout 20*a*. After a further interval, the adjacent junction comes into operation, to divert flow to spout 20*b*.

The casting wheel 10 further includes a conveyor system 34 which has a series of ingot moulds 36. System 34 is operable under the action of drive means (not shown) for moving moulds 36 along a mould line extending below axis X—X. Each mould 36 is coupled to a respective chain or belt shown schematically at reference number 7 of system 34, by which moulds 36 are advanced along the mould line by an advancement means shown schematically at reference number 38.

The drive for rotating wheel member 12 on axis X—X is synchronised with the drive for moving moulds 36 along the mould line. The arrangement is such that, as each of spouts 20*a* to 20*h* reaches the pouring position shown for spout 20*a*, a respective mould 36 reaches a filling position. Only three of moulds 36 of system 34 are illustrated in FIG. 1, with these being distinguished as moulds 36*a*, 36*b* and 36*h* to highlight their association with spouts 20*a*, 20*b* and 20*h*, respectively. As will be appreciated, mould 36*a* is shown as being in the filling position.

The mould line is substantially perpendicular to axis X—X. The vertical spacing between the mould line and axis X—X, and the location of mould line longitudinally of axis X—X is such as to provide a required working relationship between spouts 20 and moulds 36. This relationship, which also is dependent on the synchronism of rotation of wheel member 12 and movement of moulds 36, brings the outlet end 24 of each of spouts 20 into a required relationship with its respective mould 36.

As shown in FIG. 1, the outlet end 24 of spout 20*b* is over and has commenced entry to mould 36*b*. Spout 20*a* is in the pouring position, while mould 36*a* is at the filling position, such that the outlet end 24*b* of spout 20*a* is closely adjacent the base of mould 36*a*. As junction 32 between spouts 20*a* and 20*h* has commenced traversal across the discharge end 30 of pipe 28, it has reached a position in which it has become able to commence the diversion of flow of molten metal from inlet end 23 of spout 20*h* to the inlet end 23 of spout 20*a*. Thus molten metal flowing from discharge end 30 to inlet end 23 of spout 20*a* is able to flow through spout 20*a* and discharge via its outlet end 24 into mould 36*a*. Flow of molten metal through and discharge from a spout 20 is illustrated in FIG. 3 and it is to be noted that the arrangement results in flow of minimum turbulence. Also, the close positioning of outlet end 24 to the base of the mould 36*a* further minimises turbulence with consequential minimisation of the risk of dross formation.

The filling of mould 36*a* continues as it advances beyond the filling position to a position just beyond that shown as occupied by mould 36*h* in FIG. 1. During this, rotation of spout 20*a* beyond the position occupied by spout 20*h*, causes elevation of its outlet end 24. The arrangement preferably is such as to achieve underpouring of the moulds 36*a* (ie. the outlet end 24 of spout 20*a* remains close to, but just below, the rising level of molten metal in mould 36*a*) this again minimising turbulence and the risk of dross formation. A position is reached in which junction 32 commences the diversion of flow from spout 20*a* to spout 20*b*. This diversion is complete when mould 36*a* is filled with a required volume of metal, and the outlet end 24 of spout 20*a* is elevated away from mould 36*a*, and the mould 36*a* advances beyond wheel member 12.

FIGS. 1, 2 and 3 illustrate a casting wheel made and found to operate efficiently for casting of ingots of magnesium with negligible formation of oxide or dross and with an ingot mass deviation of 8.0 kg±0.1 kg. This casting, of course, necessitated operation under a protective gas atmosphere, as required for protection of a magnesium melt. The suitability of the casting wheel of the present invention for casting magnesium reflects a significant departure from known casting wheels used for casting aluminium ingots and procedures for casting magnesium ingots. The casting wheel of the present invention is relatively inexpensive and enables heat loss from the molten metal to the wheel member to be minimised, with avoidance of the need for external heating of that member to offset heat loss. Also, the casting wheel is well suited to manufacture on a scale suitable for obtaining high volume commercial production of ingots.

Figure 6:
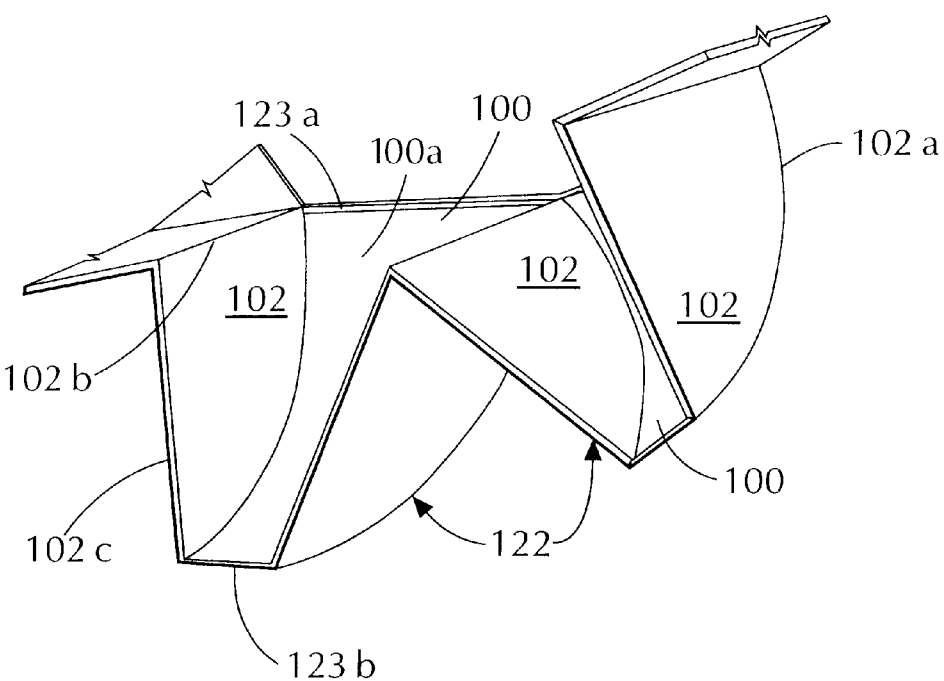
FIG. 6 is a partial perspective view of the wheel member of FIG. 5.
Figure 5:
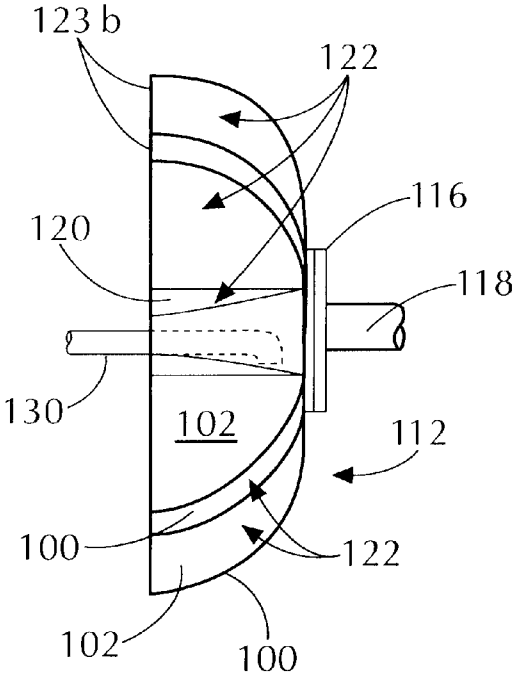
FIG. 5 is a schematic side elevation of an alternative form of wheel member.

FIGS. 5 and 6 illustrate a wheel member 112 formed of sheet metal components which are welded together. Member 112 has a central hub 116 by which it is connected to and rotatable with horizontally disposed shaft 118, in the manner described with reference to wheel member 12 of FIGS. 1 and 2. Member 112 further includes eight angularly disposed spouts 122 of which only part of the exterior of five is visible in FIG. 5. Also, as with wheel member 12 of FIGS. 1 and 2, the forward face of hub 116 defines a central region 120 which leads to the inlet end 123*a* (see FIG. 4) of each spout 122.

As shown more clearly in FIG. 6, each spout 122 is in the form of a forwardly open scoop, and is defined by an arcuate centre wall 100 and a pair of side walls 102. Each centre wall 100 is welded at inlet end 123*a* of its spout 122 around and to the periphery of hub 116. From hub 116, walls 102 curve arcuately outwardly and forwardly from inlet end 123*a* to outlet end 123*b* of the respective spouts 122. The resultant forwardly facing concave surface 100*a* of each wall 100 defines a flow path for molten metal during a mould filling operation. The width of wall 100*a* decreases from inlet end 123*a* to outlet end 123*b,* to provide more positive channelling of metal flow to end 123*b*.

Each side wall 102 has the form of a quarter of a circular disc. Along its arcuate edge 102*a,* each wall 102 is welded to a respective centre wall 100 of its spout so that one of its linear edges 102*b* projects forwardly from hub 116 and the other such edge 102*c* upwardly from outlet end 123*b* of its spout 122.

Successive spouts 122 are joined together by welding along adjacent edges 102*b*. The resultant junction between edges 102*b* is similar in form and function to junctions 32 of wheel member 12 of FIGS. 1 and 2.

Operation with wheel member 112 is similar to that described in relation to member 12 of FIGS. 1 and 2. As indicated in FIG. 5, member 112 is used in association with molten metal feed means 130, and also an ingot mould conveyor system (not shown).

Figure 8:
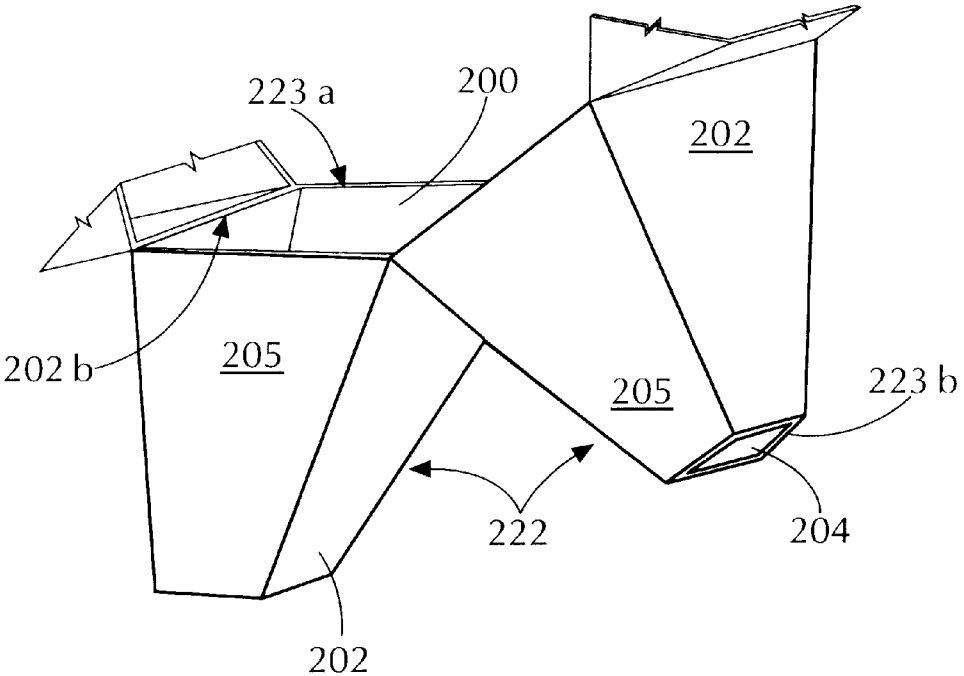
FIGS. 7 and 8 correspond respectively to FIGS. 5 and 6, but show a still further form of wheel member.
Figure 7:
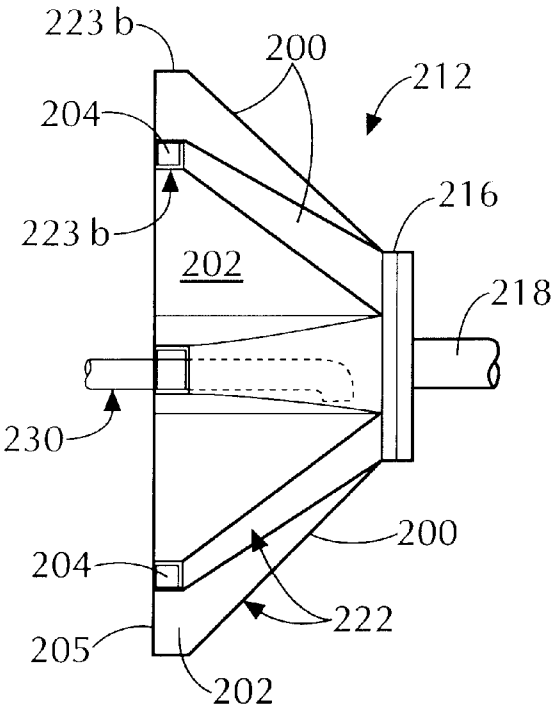

FIGS. 7 and 8 show a wheel member 212, in which components corresponding to those of member 112 of FIGS. 5 and 6 have the same reference number, plus 100. Description principally will be limited to features by which member 212 differs from member 112.

In the arrangement of FIGS. 7 and 8, each spout 222 is closed between its inlet end 223*a* and its outlet end 223*b*. Also, each spout 222 is in the form of a hopper of rectangular cross-section between its inlet end 223*a* and outlet end 223*b,* with end 223*b* defining an outlet 204 for the discharge of molten metal. Each spout has a rear wall 200, side walls 202 and a front wall 205, each formed of flat metal plate and joined to adjacent walls by welding. Each rear wall 200 is welded, at inlet end 223*a* of its spout 222, around and to part of the periphery of hub 216. From hub 216 walls 200 are inclined outwardly and forwardly, while each front wall 205 is substantially parallel to but forward of hub 216, such that the respective outlets 204 are forwardly of hub 216.

Walls 200 and 205 of each spout 222 taper slightly from the inlet end 223*a* to its outlet 204, such that the side walls 202 diverge outwardly from outlet 204 to inlet end 223*a*. Also, adjacent walls 202 of successive spouts are joined at inlet ends 223*a,* to define a respective junction 202*b* which functions as for a junction 32 of member 12 of FIGS. 1 and 2.

Again, operation with member 212 will be understood from description of casting wheel 10 of FIGS. 1 and 2. Also, molten metal feed means 230 (as with means 130 of FIGS. 5 and 6) preferably is offset from the axis of rotation in the manner described for means 26 of FIGS. 1 and 2, and for similar functioning.

With further reference to wheel member 112 of FIGS. 5 and 6, it will be appreciated that the curvature of the concave surface of each centre wall 100 controls turbulence in metal flow. The curvature may be smoothly uniform from the inlet end 123*a* to the outlet end 123*b*. However, the curvature may increase progressively and, if necessary to increase the radial extent of each spout 122, each wall 100 may have a substantially linear inner end portion which guides flow to an outer arcuate portion.

With further reference to FIGS. 7 and 8, it similarly will be appreciated that the inclination of rear walls 200 controls the flow of molten metal and enables turbulence to be minimised. Variation also is possible in this embodiment, in that the orientation of each spout 222 can be reversed. That is, the rear walls may be substantially parallel to and project radially from hub 216, with from the front walls being inclined outwardly and rearwardly from its inlet 223*a* to its outlet 204. With such variation, it of course will be the front walls along which molten metal will flow and by which its flow will be controlled. Also, in such variation, the outlet end of molten metal feed means 230 will need to have its outlet end further from hub 216, for the discharge of molten metal onto the end of the front wall adjacent the inlet end of each spout.

Finally, it is to be understood that various alterations, modifications and/or additions may be introduced into the constructions and arrangements of parts previously described without departing from the spirit or ambit of the invention.

What is claimed is:

1. A wheel member, for a casting wheel for use in filling ingot moulds of an ingot mould line, the wheel member comprising:

a hub by which the wheel member is arranged to be mounted for rotation on an axis of rotation and which defines a central region; and a plurality of spouts formed from sheet metal which are integral with the hub and extend outwardly from the central region in an angularly spaced array, each spout having an inlet end adjacent the central region and an outlet end remote from the hub.

2. A wheel member as claimed in claim 1 wherein the spouts are formed from steel sheet having a thickness of 1.5 mm–4 mm.

3. A wheel member as claimed in claim 1 wherein the spouts are formed from titanium sheet or titanium alloy sheet.

4. A wheel member as claimed in claim 1 wherein the hub is formed from metal plate, the spouts are formed from a plurality of sheet metal components, and the sheet metal components and the hub are secured together.

5. A wheel member as claimed in claim 4 wherein the sheet metal components and the hub are welded-together.

6. A wheel member as claimed in claim 1 wherein the inside of the spouts is coated with a heat insulating material.

7. A wheel member as claimed in claim 1 wherein each spout is of a closed channel form between its inlet end and its outlet end.

8. A wheel member as claimed in claim 7 wherein each spout decreases in cross-sectional area from its inlet end to its outlet end.

9. A wheel member as claimed in any claim 1 wherein each spout is of an open channel form.

10. A wheel member as claimed in claim 1 wherein the inlet ends of adjacent spouts meet at a junction.

11. A wheel member as claimed in claim 1 wherein the axis of rotation is horizontal.

12. A wheel member as claimed in claim 1 in combination with a conveyor having a series of ingot moulds corresponding to respective said spouts, said conveyor having a conveyor advancing means for moving the ingot moulds along a mould line below the wheel member, which mould line extends transversely with respect to the axis of rotation of the wheel member and wherein the conveyor moves each mould in turn to a filling position below a pouring position for spouts of the wheel member, means for rotating the wheel member, said wheel member further including molten metal feed means for supplying molten metal to the wheel member, wherein the means for rotating the wheel member includes synchronizing means cooperable with the conveyor advancing means to rotate the wheel member in synchronism with the conveyor advancing means.

13. A wheel member as claimed in claim 12 having a diameter that is selected to permit the outlet end of each said spout to be submerged in molten metal during filling of a mould that is positioned a predetermined distance from said axis of rotation.

14. The wheel member as claimed in claim 12 wherein the means for rotating the wheel member include means for maintaining continuous rotation of the wheel member to correspond to continuous advancement of the conveyor.

* * * * *